5/24/77 XR 4,024,679

United States Patent [19]

Rain et al.

[11] 4,024,679

[45] May 24, 1977

[54] AIR SUPPORTED STRUCTURE MEMBRANE CONFIGURATION

[75] Inventors: Lloyd H. Rain; Terence W. McLorg, both of Lexington, Ky.

[73] Assignee: Irvin Industries, Inc., Greenwich, Conn.

[22] Filed: Jan. 5, 1976

[21] Appl. No.: 646,736

[52] U.S. Cl. ..... 52/2; 350/316; 428/246; 428/515; 52/63

[51] Int. Cl.[2] ..... E04B 1/345

[58] Field of Search ..... 52/2, 63; 429/913; 350/316, 1, 2; 2/81, 7, 8; 220/9 D; 229/3.5 MF; 206/484; 428/246 XC, 515 XC

[56] References Cited

UNITED STATES PATENTS

| | | | |
|---|---|---|---|
| 2,999,041 | 9/1961 | Lappala | 52/2 |
| 3,048,294 | 4/1962 | Osborn | 229/3.5 MF |
| 3,061,491 | 10/1962 | Sherrard | 154/43 |
| 3,227,169 | 1/1966 | Fischer | 52/2 |
| 3,249,682 | 5/1966 | Laing | 147/28.1 |
| 3,432,609 | 3/1969 | Darall | 52/2 |
| 3,601,935 | 8/1971 | Cadwell | 52/2 |
| 3,741,631 | 6/1973 | Laing | 52/2 |
| 3,776,805 | 12/1973 | Hansen | 52/2 |
| 3,836,417 | 9/1974 | Le Masters | 52/2 |
| 3,936,984 | 2/1976 | Yando | 52/2 |

OTHER PUBLICATIONS

Architectural Record, Mar. 1976, p. 39.

*Primary Examiner*—Price C. Faw, Jr.
*Assistant Examiner*—Henry Raduazo
*Attorney, Agent, or Firm*—Beveridge, DeGrandi, Kline & Lunsford

[57] ABSTRACT

An air supported structure including a wall portion having a membrane configuration comprising a structural substrate to which a plurality of coatings or films have been applied in a manner to provide a membrane configuration having improved heat flow properties, sound and light radiation and/or absorbing qualities, structural integrity, weather resistance, and design characteristics as desired or required according to the intended use of the air supported structure.

11 Claims, 7 Drawing Figures

AIR SUPPORTED STRUCTURE MEMBRANE CONFIGURATION

BRIEF BACKGROUND, FIELD AND OBJECTIVES OF THE INVENTION

This invention relates to improvements in membrane configurations for air supported structures.

The majority of air supported structures presently in use include a single membrane envelope which has been fabricated from commercially available high strength industrial fabric, providing a low cost portable or semi-permanent enclosure which is adequately serviceable under conditions where temporary collapse due to accidental damage or vandalism would not be of serious consequence; where heat flow through the membrane is of no major concern in terms of heat gain and/or loss; and/or where sound and light radiation and/or absorbing qualities are not of any particular consequence.

Such previously provided air supported structures are generally fabricated as single skin, evenly stressed envelopes, having a wall comprising a very thin membrane, and in which the fabric of the membrane is a relatively good conductor of heat and is translucent to solar radiation. The same have also been historically extremely poor in sound characteristics, the generally highly stressed and evenly contoured single membrane thereof comprising a reflector of sound waves somewhat akin to the sound reflected from a drum head, frequently producing sound concentrations at various points in the interior of the structure and a "whispering wall" effect in which the sound produced at one point along the perimeter thereof travels thereabout and is magnified in a manner so that it is louder at a point as much as 200 to 300 feet away than at its origin.

It is obvious that lighting fixtures cannot ordinarily be mounted on the walls of an air supported structure, but must be placed around the perimeter of the structure. Thus, air supported structures are generally indirectly lighted by way of ground supported light fixtures which are focused to project light rays against the membrane for reflection from the surface thereof and onto the floor of the air supported structure. Previously provided air supported structures have generally had very poor lighting characteristics, the uniform interior surface of the envelope thereof being highly reflective, concentrating the light at some areas of the floor while leaving other areas very poorly lighted.

Also, since previously provided air supported structures were generally constructed to provide a low cost temporary enclosure, very little attention was given to designing the same for long term structural integrity and weather resistance.

The primary object of this invention is the provision of a membrane configuration which is specifically constructed for use as a wall portion of an air supported structure, the same being designed to provide an air supported structure having long term structural integrity and weather resistance, with predetermined heat flow properties and sound and light radiation and/or absorbing characteristics according to the intended use thereof.

In some instances it may prove desirable to provide a multiple membrane wall for the air supported structure. It is accordingly a further object of this invention to provide air supported structures which may be selectively of single and multiple membrane configurations having the desired total design characteristics.

Other objects and advantages of the invention will become apparent from the following detailed description, taken in connection with the accompanying drawings, and in which drawings:

DETAILED DESCRIPTION

Figure 1:
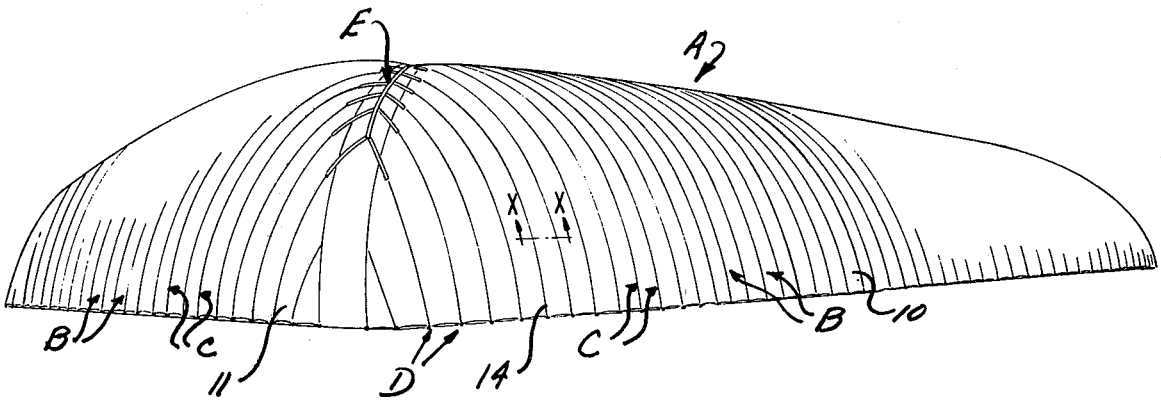
FIG. 1 is a perspective view of an air supported structure which may include a wall portion according to our invention.

In the drawings, wherein similar reference characters are used to designate corresponding parts throughout the several views, and wherein are shown various embodiments of the invention, the letter A may generally designate air supported structure which may include a wall portion comprising a plurality of panels B which may be secured in position such as by restraining webs C that may be attached at one end thereof to ground anchors D and at the other end thereof to a restraining harness E.

Air supported structure A is shown merely by way of example as to an air supported structure which may embody our invention. That is, this invention is not restricted to use in a square ended air supported structure such as is shown in FIG. 1, but may obviously be used in round ended air supported structures, circular air supported structures, and in air supported structures of various other designs. Neither is this invention restricted to an air supported structure of the particular seam design and anchor and harness relation shown for the air supported structure of FIG. 1.

As shown, some panels B may comprise side wall portion panels 10 of air supported structure A, and others may comprise end wall portions 11.

Restraining webs C may comprise a plurality of interconnected and/or interrelated webs 14 for resolving the resultants of aerodynamic and inflation pressure loads of air supported structure A.

The letter F may generally designate a panel B of single membrane configuration; the letter G a panel B of double membrane configuration; and the letter H a panel B of triple membrane configuration.

Figure 2:
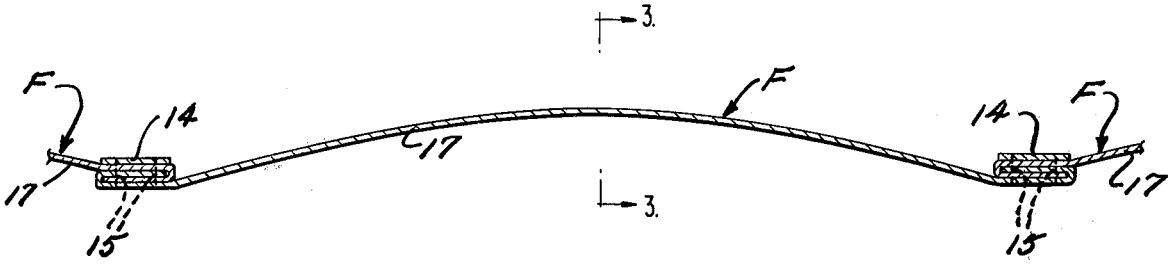
FIGS. 2, 4 and 6 are enlarged views taken respectively on line x—x of FIG. 1 and showing different membrane configurations of which such air structure may be constructed according to our invention, FIG. 2 showing a single membrane configuration, FIG. 4 a double membrane configuration, and FIG. 6 a triple membrane configuration.
Figure 3:
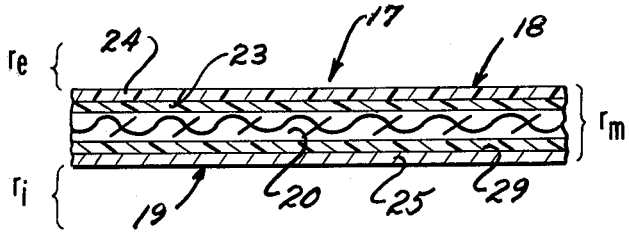
FIG. 3 is an enlarged transverse sectional view taken substantially on the line 3—3 of FIG. 2.
Figure 4:
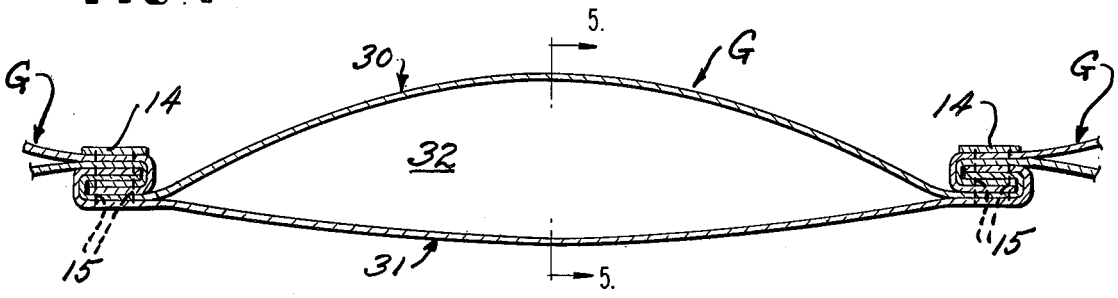
Figure 5:
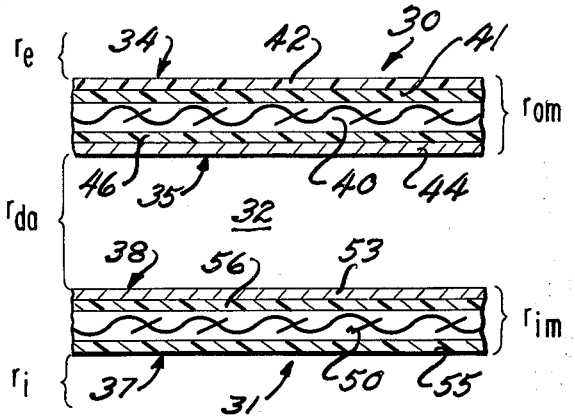
FIG. 5 is an enlarged transverse sectional view taken substantially on the line 5—5 of FIG. 4.
Figure 6:
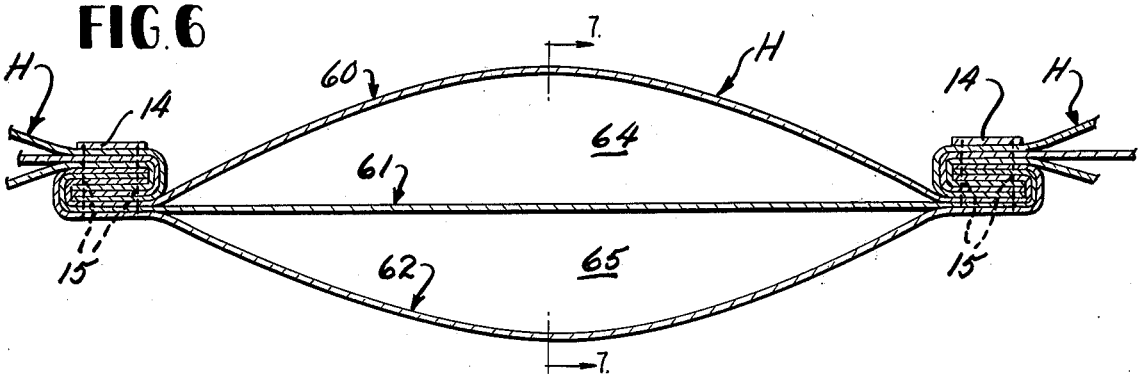
Figure 7:
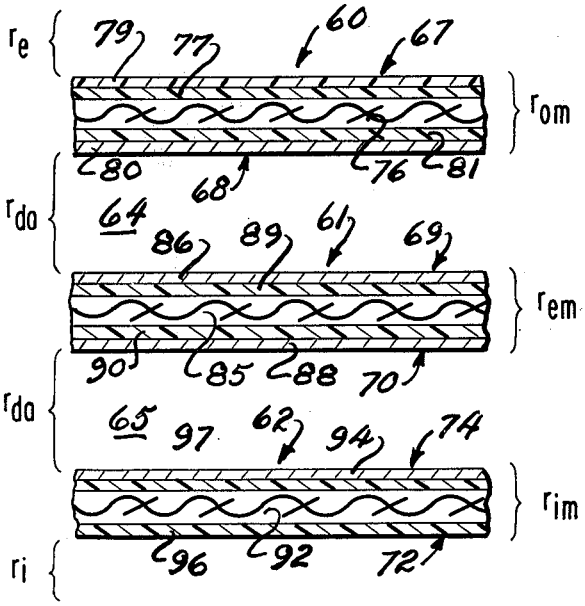
FIG. 7 is an enlarged transverse sectional view taken substantially on the line 7—7 of FIG. 6.

As respectively shown in FIGS. 2, 4 and 6, adjacent panels B of single membrane configuration F, double membrane configuration G and triple membrane configuration H may be interconnected together and to a web 14, such as by a double row of stitching 15, in a manner to provide a stress relieved seam.

The structural improvements of the present invention become readily apparent in direct comparison of the construction of a typical membrane configuration for an air supported structure with the membrane configuration of the present invention.

EXAMPLE I

TRADITIONAL MEMBRANE CONFIGURATION

The typical membrane configuration which is now generally in use for providing the wall portion of air supported structures comprises a 12-mil thick woven substrate, to the outer side of which is applied a 16-mil thick coating of vinyl, and to the interior side of which is provided a 12-mil thick coating of white vinyl.

As shown, single membrane configuration F preferably includes a single membrane 17 having an outer side 18, designed to form the exterior surface of a wall portion of the air supported structure, and an inner side 19, designed to form the interior surface of a wall portion of the air supported structure.

Single membrane 17 preferably includes a structural substrate 20, which may comprise a woven nylon filament; a long wave opacity coating 23, which may comprise black vinyl, being applied to one side of structural substrate 20; a short wave opacity coating 24 being applied over long wave opacity coating 21, which short wave opacity coating 24 may comprise the exterior surface of outer side 18 of single membrane configuration F, and which is thus preferably of wear and weather resistant material such as white polyvinyl fluoride; and the other side of structural substrate 20 being preferably provided with a long wave opacity and reflectivity coating 25, which may comprise an aluminum coating. It is sometimes difficult to obtain a good bond of an aluminum coating directly to a woven nylon substrate. Accordingly, when structural substrate 20 comprises a woven nylon filament and long wave opacity and relfectivity coating 25 comprises an aluminum coating, a coating bond 29 may be provided for bonding of the aluminum coating to the woven nylon filament. Coating bond 29 may comprise a white vinyl coating which, it will be noted, in addition to acting as a bonding medium, will also provide a short wave opacity coating on the inner side of structural substrate 20.

EXAMPLE II

SINGLE MEMBRANE CONFIGURATION F

We have found that a suitable single membrane configuration F may be provided by using a 6-mil thick woven nylon filament, to the outer side of which is applied a 10-mil thick black vinyl coating, over which is applied a 1.5-mil thick white polyvinyl fluoride coating; the inner side of the woven nylon filament having applied thereto an 8-mil thick coating of white vinyl, over which is applied a 1-mil thick aluminum coating.

As shown, double membrane configuration G preferably includes an outer membrane 30 and an inner membrane 31, there being provided a substantially dead air space 32 between spaced apart outer membrane 30 and inner membrane 31. Outer membrane 30 is provided with an outer side 34, designed to form the exterior surface of a wall portion of air supported structure, and an inner side 35. Inner membrane 31 has an inner side 37, designed to form the interior surface of a wall portion of the air supported structure, and an outer side 38. Outer side 38 of inner membrane 31 confronts inner side 35 of outer membrane 30, defining a substantially dead air space 32 therebetween.

Outer membrane 30 preferably includes a structural substrate 40, which may comprise a woven nylon filament; a long wave opacity coating 41, which may comprise black vinyl, being applied to one side of structural substrate 40; a short wave opacity coating 42 being applied over long wave opacity coating 41, which short wave opacity coating 42 may comprise the exterior surface of outer side 34 of double membrane configuration G, and which is thus preferably of wear and weather resistant material such as white polyvinyl fluoride; and the other side of structural substrate 40 being preferably provided with a long wave opacity and reflectivity coating 44, which may comprise an aluminum coating. It is sometimes difficult to obtain a good bond of an aluminum coating directly to a woven nylon substrate. Accordingly, when structural substrate 40 comprises a woven nylon filament and long wave opacity and reflectivity coating 44 comprises an aluminum coating, a coating bond 46 may be provided for bonding of the aluminum coating to the woven nylon filament. Coating bond 46 may comprise a white vinyl coating which, it will be noted, in addition to acting as a bonding medium, will also provide a short wave opacity coating on the inner side of structural substrate 40.

Inner membrane configuration 31 preferably includes a structural substrate 50, which may comprise a woven nylon filament; a long wave opacity and reflectivity coating 53 being provided on the outer side 38 of inner membrane 31, which long wave opacity and reflectivity coating 53 may comprise an aluminum coating; and the other side of structural substrate 50 being preferably provided with a short wave opacity coating 55, which may comprise white vinyl. Since, as previously discussed, it is sometimes difficult to obtain a good bond of an aluminum coating to a woven nylon substrate, when structural substrate 50 comprises a woven nylon filament and long wave opacity and reflectivity coating 53 comprises an aluminum coating, a coating bond 56 may be provided for bonding of the aluminum coating to the woven nylon filament. Coating bond 56 may comprise a white vinyl coating which, it will be noted, in addition to acting as a bonding medium, will also provide a short wave opacity coating on the outer side of structural substrate 50.

EXAMPLE III

DOUBLE MEMBRANE CONFIGURATION G

We have found that a suitable double membrane configuration G may include:

an outer membrane 30 comprising a 6-mil thick woven nylon filament, to the outer side of which is applied a 10-mil thick black vinyl coating, over which is applied a 1.5-mil thick white polyvinyl fluoride coating, the inner side of the woven nylon filament having applied thereto an 8-mil thick coating of white vinyl, over which is applied a 1-mil thick aluminum coating; and an inner membrane configuration 31 comprising a 4-mil thick woven nylon filament, to the outer side of which is applied a 2-mil thick coating of white vinyl, over which is applied a 1-mil thick aluminum coating, the inner side of the woven nylon filament having applied thereto a 4-mil thick coating of white vinyl.

As shown, triple membrane configuration H preferably includes an outer membrane 60, a center membrane 61, and an inner membrane 62, there being provided a substantially dead air space 64 between spaced apart outer membrane 60 and center membrane 61;

and a substantially dead air space 65 between spaced apart center membrane 61 and inner membrane 62. Outer membrane 60 is provided with an outer side 67, designed to form the exterior surface of a wall portion of the air supported structure, and an inner side 68. Center membrane 61 has an outer side 69 and an inner side 70. Outer side 69 of center membrane 61 confronts inner side 68 of outer membrane 60, defining a substantially dead air space 64 therebetween. Inner membrane 62 is provided with an inner side 72, designed to form the interior surface of a wall portion of the air supported structure, and an outer side 74. Outer side 74 of inner membrane 62 confronts inner side 70 of center membrane 61, defining a substantially dead air space 65 therebetween.

Outer membrane 60 preferably includes a structural substrate 76, which may comprise a woven nylon filament; a long wave opacity coating 77, which may comprise black vinyl, being applied to one side of such structural substrate 76; a short wave opacity coating 79 being applied over long wave opacity coating 77, which short wave opacity coating 70 may comprise the exterior of outer side 67 of triple membrane configuration H, and which is thus preferably of wear and weather resistant material such as white polyvinyl fluoride; and the other side of structural substrate 76 being provided with a long wave opacity and reflectivity coating 80, which may comprise an aluminum coating. It is sometimes difficult to obtain a good bond of an aluminum coating direct to a woven nylon substrate. Accordingly, when structural substrate 76 comprises a woven nylon filament and long wave opacity and reflectivity coating 80 comprises an aluminum coating, a coating bond 81 may be provided for bonding of the aluminum coating to the woven nylon filament. Coating bond 81 may comprise a white vinyl coating which, it will be noted, in addition to acting as a bonding medium, will also provide a short wave opacity coating on the inner side of structural substrate 76.

Center membrane configuration 61 preferably includes a structural substrate 85, the outer side 69 of which is provided with a long wave opacity and reflectivity coating 86, which may comprise an aluminum coating; and the inner side 70 thereof being provided with a long wave opacity and reflectivity coating 88, which may comprise an aluminum coating. As previously discussed, since it is sometimes difficult to obtain a good bond of an aluminum coating to a woven nylon substrate, when structural substrate 85 comprises a woven nylon filament and long wave opacity and reflectivity coatings 85 and 86 comprise aluminum coatings, coating bonds 89 and 90 may be provided for respectively bonding the aluminum coating of the outer and inner sides thereof to the woven nylon filament. Coating bonds 89 and 90 may comprise a white vinyl coating which, it will be noted, in addition to acting as a bonding medium, will also provide a short wave opacity coating on the inner and outer sides of structural substrate 85.

Inner membrane configuration 62 preferably includes a structural substrate 92, which may comprise a woven nylon filament; a long wave opacity and reflectivity coating 94 being provided on the outer side 74 of inner membrane 62, which long wave opacity and reflectivity coating 94 may comprise an aluminum coating; and the other side of structural substrate 92 being preferably provided with a short wave opacity coating 96, which may comprise white vinyl. Since, as previously noted, it is sometimes difficult to obtain a good bond of an aluminum coating to a woven nylon substrate, when structural substrate 92 comprises a woven nylon filament and long wave opacity and reflectivity coating 94 comprises an aluminum coating, a coating bond 97 may be provided for bonding of the aluminum coating to the woven nylon filament. Coating bond 97 may comprise a white vinyl coating which, it will be noted, in addition to acting as a bonding medium, will also provide a short wave opacity coating on the outer side of structural substrate 70.

EXAMPLE IV

TRIPLE MEMBRANE CONFIGURATION H

We have found that a suitable triple membrane configuration H may include:

- an outer membrane configuration comprising a 6-mil thick woven nylon filament, to the outer side of which is applied a 10-mil thick black vinyl coating, over which is applied a 1.5-mil thick white polyvinyl fluoride coating, the inner side of the woven nylon filament having applied thereto an 8-mil thick coating of white vinyl, over which is applied a 1-mil thick aluminum coating;
- a center membrane comprising a 4-mil thick woven nylon filament, to each side of which is applied a 2-mil thick coating of white vinyl, and over each of which is applied a 1-mil thick aluminum coating; and
- an inner membrane comprising a 4-mil thick woven nylon filament, to the outer side of which is applied a 2-mil thick coating of white vinyl, over which is applied a 1-mil thick aluminum coating, and to the inner side of which is applied a 4-mil thick coating of white vinyl.

Using the membrane configurations of Examples I–IV, a direct comparison may be made of the thermal performance of the traditional membrane configuration with those of the single, double and triple membrane configurations of the present invention.

In the case of some air supported structures, such as those used for storage, a traditional membrane configuration will likely suffice. However, in the case of air supported structures intended for use as an enclosure for recreational pursuits, such as tennis and swimming, the membrane configurations thereof are preferably provided with heat flow characteristics which will facilitate heating an air supported structure in the winter and air conditioning in the summer. A determination of the total coefficient of heat transmission for the wall portion of the air supported structure (U value) is necessary so that heat flow properties can be reasonably calculated and the heating and/or air conditioning equipment therefor be of an appropriate size and capacity. The total coefficient of heat transmission can be determined by finding the thermal resistance of a given portion of the wall portion and converting the reciprocals of the summed resistances to the U value according to the relationship:

$$U = 1/R$$

The coefficients, resistances, emissivities and methods of computation of the following comparative analyses are based on data contained in the "ASHRAE Guide"; the total resistance ($R$) of a given portion of the wall being the sum of the resistances ($r$); and wherein the "dead air space" is based upon an averaged 4-inch depth of entrapped and substantially motionless air between respective membrane configurations.

DETERMINATION OF COEFFICIENT OF HEAT TRANSMISSION DOWNWARD (SUMMER CONDITION)

TRADITIONAL MEMBRANE OF EXAMPLE I

| | Resistance |
|---|---|
| $r_e$ (exterior air film) | .25 |
| $r_m$ (white vinyl/structural substrate/white vinyl) | .06 |
| $r_i$ (interior air film) | .92 |

$$U = \frac{1}{r_e + r_m + r_i} = \frac{1}{.25 + .06 + .92} = \frac{1}{1.23} = .81 \text{ BTU/HR./SQ.FT./° F}$$

SINGLE MEMBRANE CONFIGURATION OF EXAMPLE II

| | Resistance |
|---|---|
| $r_e$ (exterior air film) | .25 |
| $r_m$ (white polyvinyl fluoride/black vinyl/ structural substrate/white vinyl/aluminum) | .28 |
| $r_i$ (interior air film) | .92 |

$$U = \frac{1}{r_e + r_m + r_i} = \frac{1}{.25 + .28 + .92} = \frac{1}{1.45} = 0.69 \text{ BTU/HR./SQ. FT./° F}$$

DOUBLE MEMBRANE CONFIGURATION OF EXAMPLE III

| | Resistance |
|---|---|
| $r_e$ (exterior air film) | .25 |
| $r_{om}$ (white polyvinyl fluoride/black vinyl/ structural substrate/white vinyl/aluminum) | .28 |
| $r_{da}$ (dead air space) | 2.33 |
| $r_{im}$ (aluminum/white vinyl/structural substrate/ white vinyl) | .26 |
| $r_i$ (interior air film) | .92 |

$$U = \frac{1}{r_e + r_{om} + r_{da} + r_{im} + r_i} = \frac{1}{.25 + .28 + 2.33 + .26 + .92} = \frac{1}{4.04} = 0.25 \text{ BTU/HR./SQ.FT./° F}$$

TRIPLE MEMBRANE CONFIGURATION OF EXAMPLE IV

| | Resistance |
|---|---|
| $r_e$ (exterior air film) | .25 |
| $r_{om}$ (white polyvinyl fluoride/black vinyl/ structural substrate/white vinyl/aluminum) | .28 |
| $r_{da}$ (dead air space) | 2.33 |
| $r_{em}$ (aluminum/white vinyl/structural substrate/ white vinyl/aluminum | 0.6 |
| $r_{da}$ (dead air space) | 2.33 |
| $r_{im}$ (aluminum/white vinyl/structural substrate/ white vinyl) | .26 |
| $r_i$ (interior air film) | .92 |

$$U = \frac{1}{r_e + r_{om} + r_{da} + r_{em} + r_{da} + r_{im} + r_i} = \frac{1}{.25 + .28 + 2.33 + 0.6 + 2.33 + .26 + .92} = \frac{1}{6.43} = 0.16 \text{ BTU/HR./SQ.FT./° F}$$

DETERMINATION OF COEFFICIENT OF HEAT TRANSMISSION UPWARD (WINTER CONDITION)

TRADITIONAL MEMBRANE OF EXAMPLE I

| | Resistance |
|---|---|
| $r_e$ (exterior air film) | .17 |
| $r_m$ (white vinyl/structural substrate/white vinyl) | .06 |
| $r_i$ (interior air film) | .61 |

$$U = \frac{1}{r_e + r_m + r_i} = \frac{1}{.17 + .06 + .61} = \frac{1}{.84} = 1.19 \text{ BTU/HR./SQ.FT./° F}$$

-continued

DETERMINATION OF COEFFICIENT OF HEAT TRANSMISSION UPWARD (WINTER CONDITION)

SINGLE MEMBRANE CONFIGURATION OF EXAMPLE II

| | Resistance |
|---|---|
| $r_e$ (exterior air film) | .17 |
| $r_m$ (white polyvinyl fluoride/black vinyl/ structural substrate/white vinyl/aluminum) | .28 |
| $r_i$ (interior air film) | .61 |

$$U = \frac{1}{r_e + r_m + r_i} = \frac{1}{.17 + .28 + .61} = \frac{1}{1.06} = 0.94 \text{ BTU/HR./SQ.FT./° F}$$

DOUBLE MEMBRANE CONFIGURATION OF EXAMPLE III

| | Resistance |
|---|---|
| $r_e$ (exterior air film) | .17 |
| $r_{om}$ (white polyvinyl fluoride/black vinyl/ structural substrate/white vinyl/aluminum | .28 |
| $r_{da}$ (dead air space) | 1.71 |
| $r_{im}$ (aluminum/white vinyl/structural substrate/ white vinyl) | .26 |
| $r_i$ (interior air film) | .61 |

$$U = \frac{1}{r_e + r_{om} + r_{da} + r_{im} + r_i} = \frac{1}{.17 + .28 + 1.71 + .26 + .61} = \frac{1}{3.03} = 0.33 \text{ BTU/HR./SQ.FT./° F}$$

TRIPLE MEMBRANE CONFIGURATION OF EXAMPLE IV

| | Resistance |
|---|---|
| $r_e$ (exterior air film) | .17 |
| $r_{om}$ (white polyvinyl fluoride/black vinyl/ structural substrate/white vinyl/aluminum) | .28 |
| $r_{da}$ (dead air space) | 1.71 |
| $r_{em}$ (aluminum/white vinyl/structural substrate/ white vinyl/aluminum) | .06 |
| $r_{da}$ (dead air space) | 1.71 |
| $r_{im}$ (aluminum/white vinyl/structural substrate/ white vinyl) | .26 |
| $r_i$ (interior air film) | .61 |

$$U = \frac{1}{r_e + r_{om} + r_{da} + r_{em} + r_{da} + r_{im} + r_i} = \frac{1}{.17 + .28 + 1.71 + .06 + 1.71 + .26 + .61} = \frac{1}{4.80} = 0.21 \text{ BTU/HR./SQ.FT./° F}$$

TABLE OF "U" VALUES

Heat Flow Shown in BTU/HR./SQ.FT./° F

| CONFIGURATION | HEAT FLOW DOWNWARD (SUMMER) | HEAT FLOW UPWARD (WINTER) |
|---|---|---|
| Traditional | 0.81 | 1.19 |
| Single Membrane | 0.69 | 0.94 |
| Double Membrane | 0.25 | 0.33 |
| Triple Membrane | 0.16 | 0.21 |

From the above comparisons it will be seen that the membrane configurations of the present invention have a coefficient of heat transmission which is on the order of from 1/5 to ⅛ of those inherent in the typical traditional membrane configuration. Accordingly, considering the present day rapidly increasing energy costs, it is estimated that any extra costs necessitated in designing and furnishing an air supported structure having a membrane configuration according to the present invention, over the cost of a traditional air structure, will be reimbursed to the buyer within less than 2 years' time by way of savings from the operation of heating and air conditioning equipment.

Various changes in the forms of the invention herein shown and described may be made without departing from the spirit of the invention or the scope of the following claims.

We claim:

1. An air supported structure including a wall portion having a membrane configuration provided with an outer side and inner side and comprising structural substrate having a long wave opacity coating on one side thereof, a short wave opacity coating being applied over said long wave opacity coating; and a coating having long wave opacity and reflectivity being applied on the other side of said structural substrate, said long wave opacity coating side of said structural substrate forming the outer side of said membrane configuration and said coating having long wave opacity and reflectivity coating side of said structural substrate forming the inner side of said membrane configuration; said long wave opacity coating comprising black vinyl, said short wave opacity coating comprising white polyvinyl flouride, and said coating having long wave opacity and reflectivity comprising an aluminized coating; said structural substrate comprising a woven nylon filament having a coating bond applied to the side thereof opposite said long wave opacity coating side thereof, said coating having long wave opacity and reflectivity being applied over said coating bond; said long wave opacity coating comprising black vinyl, said short wave opacity coating comprising white polyvinyl fluoride, said coating bond comprising white vinyl, and said coating having long wave opacity and reflectivity comprising an aluminized coating.

2. An air supported structure including a wall portion having an outer membrane configuration and an inner membrane configuration, said outer membrane configuration and said inner membrane configuration being joined to each other along the side edges thereof and being spaced apart from each other throughout substantially the entire remaining extent thereof to provide a substantially dead air space therebetween; said outer membrane configuration having an outer side and an inner side and including a structural substrate having a long wave opacity coating on the outer side thereof, a short wave opacity coating provided over said long wave opacity coating and a long wave opacity and reflectivity coating on the inner side thereof; said inner member configuration having an outer side and an inner side and including a structural substrate having a long wave opacity and reflectivity coating on the outer side thereof and a short wave opacity coating on the inner side thereof; the inner side of said outer membrane configuration confronting the outer side of said inner membrane configuration.

3. An air supported structure as specified in claim 2 wherein each said long wave opacity and reflectivity coating comprises an aluminized coating.

4. An air supported structure as specified in claim 2 wherein said long wave opacity coating of said outer membrane configuration comprises black vinyl, said short wave opacity coating of said outer membrane configuration comprises white polyvinyl fluoride, and said coating having long wave opacity and reflectivity of each said outer membrane configuration and said inner membrane configuration comprises an aluminized coating, and said short wave opacity coating of said inner membrane configuration comprises white vinyl.

5. An air supported structure as specified in claim 2 wherein each said structural substrate comprises a woven nylon filament and a coating bond is applied over each said woven nylon filament intermediate said long wave opacity and reflectivity coating of each said membrane configuration and said structural substrate.

6. An air supported structure as specified in claim 5 wherein said long wave opacity coating comprises black vinyl, said short wave opacity coating of said outer membrane configuration comprises white polyvinyl fluoride, said coating bond of each said membrane configuration and said short wave opacity coating of said inner membrane configuration comprises white vinyl, and said coating having long wave opacity and reflectivity of each said membrane configuration comprises an aluminized coating.

7. An air supported structure including a wall portion having an outer membrane configuration, a center membrane configuration, and an inner membrane configuration, said outer, center and inner membrane configurations being joined together along the side edges thereof and being spaced apart from each other throughout substantially the entire remaining extent thereof to provide a substantially dead air space between said outer membrane and said center member and between said center membrane and said inner membrane; said outer membrane configuration having an outer side and an inner side and including a structural substrate having a long wave opacity coating on the outer side thereof, a short wave opacity coating provided over said long wave opacity coating and a long wave opacity and reflectivity coating on the inner side thereof; said center membrane configuration having an outer side and an inner side and including a structural substrate having a long wave opacity and reflectivity coating on the outer side thereof, a short wave opacity coating on the inner side thereof, and a long wave opacity and reflectivity coating provided over said short wave opacity coating thereof; said inner membrane having an outer side and an inner side and including a structural substrate having a long wave opacity and reflectivity coating on the outer side thereof and a short wave opacity coating on the inner side thereof; the outer side of said center membrane configuration confronting the inner side of said outer membrane configuration and the inner side of said center membrane configuration confronting the outer side of said inner membrane configuration.

8. An air supported structure as specified in claim 7 wherein each said long wave opacity and reflectivity coating comprises an aluminized coating.

9. An air supported structure as specified in claim 7 wherein said long wave opacity coating of said outer membrane configuration comprises black vinyl, said short wave opacity coating of said outer membrane configuration comprises white polyvinyl fluoride, each said coating having long wave opacity and reflectivity comprises an aluminized coating, and said short wave opacity coating of each said center membrane configuration and said inner membrane configuration comprises white vinyl.

10. An air supported structure as specified in claim 9 wherein each said structural substrate comprises a woven nylon filament and a coating bond is applied over each said woven nylon filament intermediate said long wave opacity and reflectivity coating of each the said inner side of said outer membrane configuration and outer side of each said center and inner membrane configuration.

11. An air supported structure as specified in claim 10 wherein said long wave opacity coating comprises black vinyl, said short wave opacity coating of said outer membrane configuration comprises white polyvinyl fluoride, said coating bond of each said membrane configuration and said short wave opacity coating of each said center and inner membrane configuration comprises white vinyl, and said coating having long wave opacity and reflectivity of each said membrane configuration comprises an aluminized coating.

* * * * *

UNITED STATES PATENT AND TRADEMARK OFFICE

Certificate

Patent No. 4,024,679 Patented May 24, 1977

Lloyd H. Rain and Terence W. McLorg

Application having been made by Lloyd H. Rain and Terence W. McLorg, the inventors named in the patent above identified, and Irvin Industries, Inc., Greenwich, Connecticut, a corporation of New York, the assignee, for the issuance of a certificate under the provisions of Title 35, Section 256, of the United States Code, adding the name of James J. Ford as a joint inventor, and a showing and proof of facts satisfying the requirements of the said section having been submitted, it is this 10th day of October 1978, certified that the name of the said James J. Ford is hereby added to the said patent as a joint inventor with the said Lloyd H. Rain and Terence W. McLorg.

FRED W. SHERLING,
*Associate Solicitor.*